United States Patent [19]

Cha

[11] 4,191,251

[45] Mar. 4, 1980

[54] PROCESS FOR RECOVERING CARBONACEOUS VALUES FROM IN SITU OIL SHALE RETORTING

[75] Inventor: Chang Y. Cha, Bakersfield, Calif.

[73] Assignee: Occidental Oil Shale, Inc., Grand Junction, Colo.

[21] Appl. No.: 930,022

[22] Filed: Aug. 1, 1978

Related U.S. Application Data

[63] Continuation of Ser. No. 844,035, Oct. 20, 1977, abandoned, which is a continuation-in-part of Ser. No. 728,911, Oct. 4, 1976, abandoned, which is a continuation-in-part of Ser. No. 648,358, Jan. 12, 1976, abandoned, which is a continuation of Ser. No. 465,097, Apr. 29, 1974, abandoned.

[51] Int. Cl.[2] ..... E21B 43/24

[52] U.S. Cl. ..... 166/260; 166/261; 166/259; 299/2

[58] Field of Search ..... 166/260, 261, 256, 247, 166/272, 259, 302; 299/2, 13

[56] References Cited

U.S. PATENT DOCUMENTS

| | | | |
|---|---|---|---|
| 2,771,952 | 11/1956 | Simm | 166/260 |
| 2,801,089 | 7/1957 | Scott, Jr. | 299/2 |
| 3,001,776 | 9/1961 | van Poollen | 299/2 |
| 3,026,937 | 3/1962 | Simm | 166/260 |
| 3,316,020 | 4/1967 | Bergstrom | 299/2 |
| 3,342,257 | 9/1967 | Jacobs et al. | 166/247 |
| 3,362,471 | 1/1968 | Slusser et al. | 166/251 |
| 3,437,348 | 4/1969 | Smith | 299/2 |
| 3,454,958 | 7/1969 | Parker | 166/272 X |
| 3,533,469 | 10/1970 | Parker | 166/247 X |
| 3,586,377 | 6/1971 | Ellington | 299/2 X |
| 3,601,193 | 8/1971 | Grady | 166/259 X |
| 3,661,423 | 5/1972 | Garrett | 299/13 X |

FOREIGN PATENT DOCUMENTS 17162 7/1976 Morocco .

*Primary Examiner*—Stephen J. Novosad
*Attorney, Agent, or Firm*—Christie, Parker & Hale

[57] ABSTRACT

An in situ oil shale retort containing a fragmented permeable mass of formation particles containing oil shale is formed in a subterranean formation containing oil shale. To retort oil shale in the retort, a primary combustion zone is established in the fragmented mass. A primary combustion zone feed containing oxygen is introduced to the primary combustion zone for advancing the primary combustion zone through the fragmented mass. A secondary combustion zone is established in the fragmented mass on the trailing side of the primary combustion zone. A retort feed mixture is introduced into the secondary combustion zone. The retort feed mixture contains sufficient fuel and oxygen for maintaining the secondary combustion zone and for forming a primary combustion zone feed containing oxygen for advancing the primary combustion zone through the fragmented mass.

77 Claims, 2 Drawing Figures

PROCESS FOR RECOVERING CARBONACEOUS VALUES FROM IN SITU OIL SHALE RETORTING

CROSS REFERENCE TO RELATED APPLICATIONS

This is a continuation of application Ser. No. 844,035, filed Oct. 20, 1977 which is a continuation-in-part of application Ser. No. 728,911 filed on Oct. 4, 1976, now abandoned which is a continuation-in-part of application Ser. No. 648,358, filed Jan. 12, 1976, now abandoned, which is a continuation of application Ser. No. 465,097, filed Apr. 29, 1974, and now abandoned. The disclosures of these three patent applications are incorporated herein by this reference.

BACKGROUND OF THE INVENTION

The presence of large deposits of oil shale in the Rocky Mountain region of the United States has given rise to extensive efforts to develop methods of recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen", which upon heating decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen bearing shale and processing the shale on the surface, or processing the shale in situ. The latter approach is preferable from the standpoint of environmental impact since the spent shale remains in place, reducing the chance of surface contamination and the requirement for disposal of solid wastes.

The recovery of liquid and gaseous products from oil shale deposits has been described in several patents, one of which is U.S. Pat. No. 3,661,423, issued May 9, 1972, to Donald E. Garrett, assigned to the assignee of this application and incorporated herein by reference. This patent describes in situ recovery of liquid and gaseous hydrocarbon materials from a subterranean formation containing oil shale by fragmenting such formation to form a stationary, fragmented permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing "retorted oil shale".

One method of supplying hot retorting gases used for converting kerogen contained in the oil shale, as described in U.S. Pat. No. 3,661,423, includes establishment of a combustion zone in the retort and introduction of an oxygen containing retort inlet mixture into the retort as an oxygen supplying gaseous combustion zone feed to advance the combustion zone downwardly through the retort. In the combustion zone oxygen in the combustion zone feed is depleted by reaction with hot carbonaceous materials to produce heat and combustion gas. By the continued introduction of the retort inlet mixture into the retort, the combustion zone is advanced through the retort.

The combustion gas and the portion of the combustion zone feed that does not take part in the combustion process pass through the fragmented mass in the retort on the advancing side of the combustion zone to heat the oil shale in a retorting zone to a temperature sufficient to produce kerogen decomposition, called retorting, in the oil shale to gaseous and liquid products including gaseous and liquid hydrocarbon products and to a residual solid carbonaceous material.

The liquid products and gaseous products are cooled by the cooler oil shale fragments in the retort on the advancing side of the retorting zone. The liquid hydrocarbon products, together with water produced in or added to the retort, are withdrawn from the retort on the advancing side of the retorting zone. An off gas containing combustion gas generated in the combustion zone, gaseous products produced in the retorting zone, gas from carbonate decomposition, and any gaseous retort inlet mixture that does not take part in the combustion process is also withdrawn from the retort on the advancing side of the retorting zone. The products of retorting are referred to herein as liquid and gaseous products.

The residual carbonaceous material in the retorted oil shale can be used as fuel for advancing the combustion zone through the retorted oil shale. When the residual carbonaceous material is heated to its spontaneous ignition temperature it reacts with oxygen. The portion of the retort where the greater part of the oxygen in the retort inlet mixture that reacts with residual carbonaceous material in retorted oil shale is consumed is called the primary combustion zone. As the residual carbonaceous material becomes depleted in the combustion process, the oxygen penetrates farther into the oil shale retort where it combines with remaining unoxidized residual carbonaceous material, thereby causing the combustion zone to advance through the fragmented mass containing oil shale.

The rate of retorting of the oil shale to liquid and gaseous products is temperature dependent, with relatively slow retorting occurring at 600° F., and relatively rapid retorting of the kerogen in oil shale occurring at 950° F. and higher temperatures. As the retorting of a segment of the fragmented oil shale in the retorting zone progresses and less heat is extracted from the gases passing through the segment, the combustion gas heats the oil shale farther on the advancing side of the combustion zone to retorting temperatures, thus advancing the retorting zone on the advancing side of the combustion zone.

It can be desirable to limit the oxygen content of the combustion zone feed to about 15%. At oxygen concentrations higher than about 15%, high primary combustion zone temperatures resulting in fusion of the oil shale can occur if a high volumetric flow rate of combustion zone feed is provided. This to reduce the oxygen content of air, which is presently the most economical source of oxygen, the air can be diluted with a portion of off gas generated by retorting of oil shale. However, it has been found that when recycled off gas is used to dilute the air, the off gas from the retort can have a fuel value as low as about 45 BTU/SCF (British thermal units per standard cubic foot), which can be insufficient to power a work engine.

It is desirable to provide a method for retorting an in situ oil shale retort such that the retort off gas generated during retorting has sufficient fuel value for combustion in a stack or for use in power generation in a work engine.

The introduction of a retort inlet mixture into the retort on the trailing side of the combustion zone and the flowing of such gas therethrough generally reduces the temperature of the fragmented permeable mass of particles on the trailing side of the combustion zone. When the retort inlet mixture is introduced into the retort at atmospheric temperature, the fragmented permeable mass on the trailing side of the combustion zone can have its temperature reduced to a temperature below the retorting temperature of oil shale. This reduction in temperature terminates the retorting of oil shale in unfragmented formation adjacent to such fragmented permeable mass of particles, thereby reducing the recovery from the retort.

This reduction in temperature can also reduce the temperature of residual carbonaceous material in oil shale on the trailing side of the primary combustion zone to a temperature below the spontaneous ignition temperature of such materials. Residual carbonaceous material so cooled cannot be oxidized to provide the energy required for the endothermic retorting of oil shale, thereby requiring oxidation of organic materials which otherwise could be retorted to yield hydrocarbon products.

Thus, it is desirable to provide a method for recovering liquid and gaseous products from an in situ oil shale retort which yields off gas of sufficient fuel value to operate a work engine and which gives high recovery of product.

SUMMARY OF THE INVENTION

In a method according to this invention, a primary combustion zone is established in an in situ oil shale retort in a subterranean formation containing oil shale. The retort contains a fragmented permeable mass of formation particles containing oil shale. The primary combustion zone is advanced through the fragmented mass by introducing a primary combustion zone feed comprising oxygen into the primary combustion zone.

A secondary combustion zone is established in the fragmented mass on the trailing side of the primary combustion zone. This can be effected by introducing a retort inlet mixture comprising oxygen and fuel into a selected location in the fragmented mass on the trailing side of the primary combustion zone. The spontaneous ignition temperature of the retort inlet mixture is less than the temperature of the primary combustion zone and less than the temperature of the selected location. The secondary combustion zone can supply heat to unfragmented formation adjacent the fragmented permeable mass of particles for retorting oil shale in the unfragmented formation.

The composition of the fuel of the retort inlet mixture and the proportion of the fuel to the air of the retort inlet mixture can be controlled such that the volume (STP) of the primary combustion zone feed on a dry basis is less than the volume (STP) of the introduced air.

DRAWINGS

These and other features, aspects and advantages of the present invention will become more apparent when considered with respect to the following description, appended claims, and accompanying drawings where:

DESCRIPTION

This invention concerns an improved method for producing liquid and gaseous products in an in situ oil shale retort having boundaries of unfragmented formation referred to herein as "walls", and containing a fragmented permeable mass of particles. A primary combustion zone is advanced through the fragmented permeable mass of particles. A secondary combustion zone is maintained on the trailing side of the primary combustion zone by introducing a retort inlet mixture comprising fuel and oxygen to a selected location in the fragmented mass on the trailing side of the primary combustion zone. The retort inlet mixture comprises an excess of oxygen over that needed to oxidize the fuel. The secondary combustion zone is established and maintained in the portion of the retort where fuel in the retort inlet mixture is burned. The secondary combustion zone supplies heat to the fragmented permeable mass of particles on the trailing side of the combustion zone. Preferably, sufficient heat is generated in the secondary combustion zone to maintain the temperature of the retort walls adjacent the secondary combustion zone at a temperature above the retorting temperature of oil shale. The advance of the primary combustion zone through the retort causes retorting of oil shale and the production of liquid and gaseous products.

Figure 1:
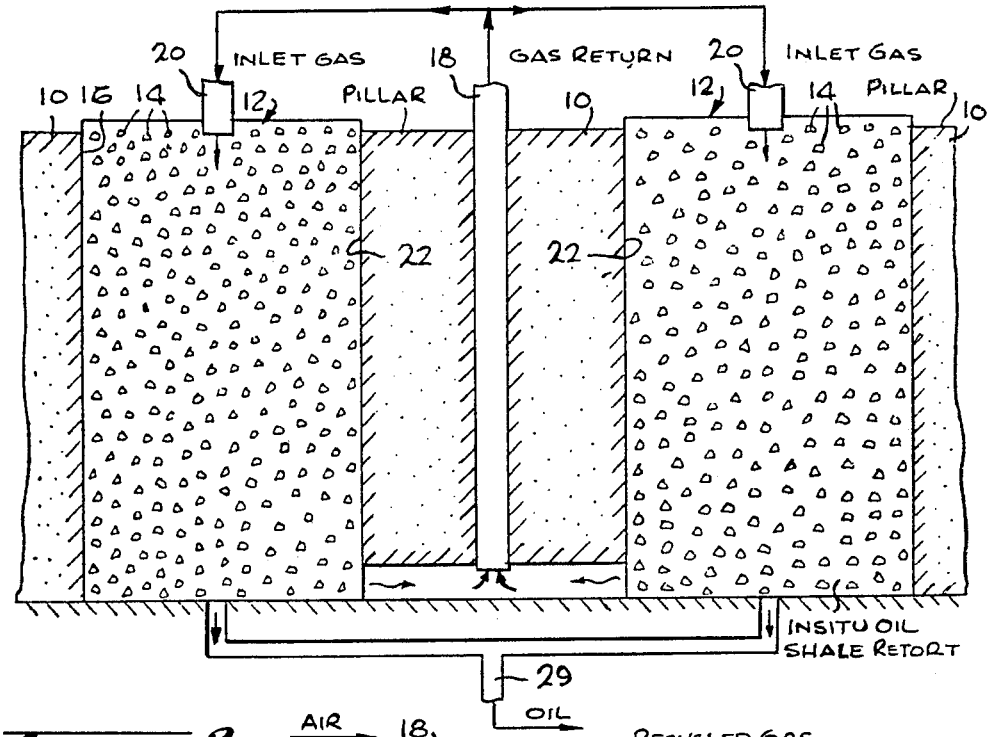
FIG. 1 illustrates semi-schematically two in situ oil shale retorts.

This invention is described with reference to FIG. 1, where there is illustrated a plurality of retort walls or pillars 10 adjacent a plurality of in situ oil shale retorts 12. A subterranean oil shale formation is fragmented to form a stationary, fragmented, permeable mass 14 of formation particles containing oil shale. The pillars 10 comprise formation containing oil shale. The amount of the formation remaining as pillars serving as retort walls can be as much as about 20% to about 40% of the portion of the total deposit containing the retorts 12.

The pillars remaining between the retorts prevent gas flow between retorts. The oil shale in the pillars has little if any porosity and permeability. However, as kerogen in the oil shale is decomposed and the retorting products leave the oil shale, the permeability and porosity increase. Therefore, since retorting progresses into the pillar from the heated retort, retorting products including shale oil produced inside the pillars 10 tend to move toward the retorts where the products pass through a high temperature interfacial zone 16 at the retort wall 22 provided by the pillars. In the movement of these products through this high temperature interfacial zone, thermal cracking of the shale oil can occur, resulting in the production of a light oil and gas. This gas and light oil mix with gases such as hydrocarbons, hydrogen and carbon monoxide formed in the primary combustion zone 32 and retorting zone 12 (see FIG. 2) during in situ retorting of the fragmented permeable mass containing oil shale 14 in the retorts 12 to form a retort off gas.

To retort oil shale in the pillars at elevations above the primary combustion zone, this invention provides for establishment of a secondary combustion zone on the trailing side of the primary combustion zone. Sufficient heat can be generated in the secondary combustion zone to maintain the temperature of retort walls adjacent the secondary combustion zone at a temperature greater than the retorting temperature of oil shale. Preferably, this temperature is greater than about 900°

F. and more preferably greater than about 1000° F. It is particularly preferred to maintain the retort walls adjacent the secondary combustion zone at a temperature higher than about 1200° F. At the higher temperatures, additional products are recovered from the pillars and the fuel value of the retort off gas is enhanced. Therefore, preferably the secondary combustion zone is maintained at a temperature above about 900° F., and more preferably at a temperature higher than about 1200° F.

It has been calculated that a 900° F. isotherm, i.e., a retorting zone having a temperature of 900° F., will advance through a pillar at a rate of about 1.34 inches per day when the surface of the pillar is maintained at a temperature of 1200° F.

In the absence of the secondary combustion zone, gases introduced into the retort on the trailing side of a primary combustion zone and the flowing of such gases therethrough generally reduce the temperature of the fragmented permeable mass of particles on the trailing side of the primary combustion zone. When the gases are introduced into the retort at about atmospheric temperature, a portion of the fragmented permeable mass on the trailing side of the primary combustion zone can have its temperature reduced to a temperature below the retorting temperature of oil shale. The reduction in temperature terminates the retorting of oil shale in the pillars adjacent to such fragmented permeable mass of particles, thereby reducing the recovery of shale oil from the retort. This reduction in temperature also reduces the temperature of a portion of the solid carbonaceous materials on the trailing side of the primary combustion zone to a temperature below the spontaneous ignition temperature of such materials, thereby eliminating some of the residual carbonaceous material as a source of energy for the endothermic retorting of oil shale.

Figure 2:
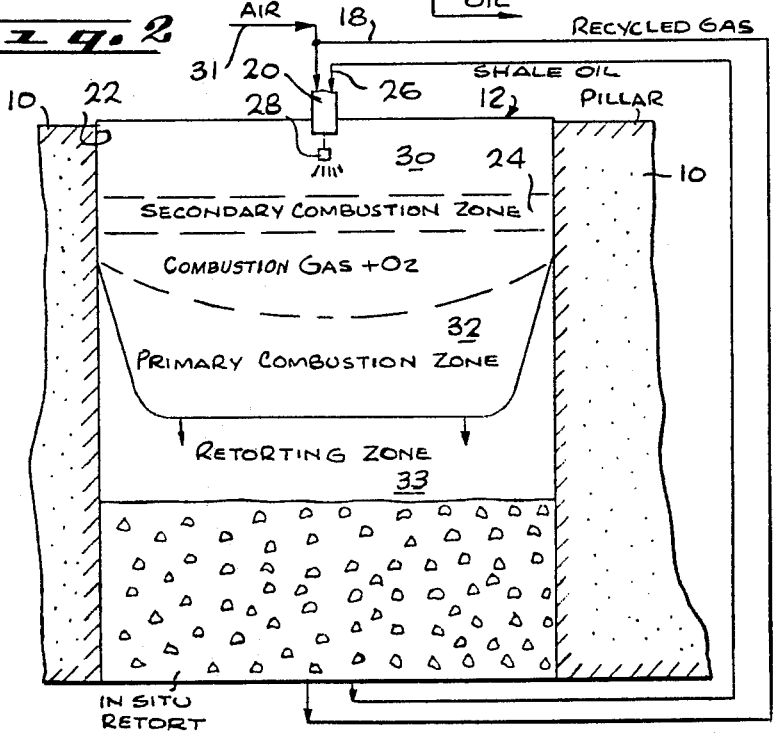
FIG. 2 illustrates the location of primary and secondary combustion zones during in situ oil shale retorting according to principles of this invention, employing the in situ oil shale retorts illustrated in FIG. 1.

As shown in FIG. 2, the secondary combustion zone is established and maintained in a top portion or region of the fragmented permeable mass in the retort near an inlet 20 to the fragmented mass. This is preferred because oil shale on the trailing side of the primary combustion zone and oil shale in unfragmented formation adjacent the fragmented mass on the trailing side of the primary combustion zone are maintained at an elevated temperature due to flowing gases passing from the secondary combustion zone. The closer the secondary combustion zone is to the top of the fragmented mass, the greater the amount of oil shale in the fragmented mass and oil shale in the walls maintained at an elevated temperature, and therefore the greater the amount of kerogen available for retorting and the greater the amount of residual carbonaceous material available for oxidation.

To provide high temperatures at the wall 22 of retorts 12 formed by the adjacent pillars 10 for an increased or extended time period, this invention provides for the establishment of a secondary combustion zone as indicated at 24 in FIG. 2. Such a secondary combustion zone 24 is illustrated as being located near the top of the retort 12 and can be maintained at substantially the same location throughout the in situ retorting operation. In one embodiment, the secondary combustion zone is initiated by injecting shale oil 26, produced during retorting, via a shale oil sprayer 28, and introducing via an inlet 20 a mixture of air 31 and recycled off gas 18 also produced in retorting, into the top portion 30 of the retort as a retort inlet mixture. Shale oil is removed as product by means of an oil pumping line 29 as shown in FIG. 1. Off gas can be withdrawn from the bottom of the retort by a blower (not shown). Instead of or in addition to recycled off gas, steam can be included in the retort inlet mixture.

In the embodiment shown in FIG. 2, only a portion of the off gas from the bottom of the retort is recycled through the retort.

In the embodiment shown in FIG. 2, the injection rate of shale oil into the top of the respective retorts 12 is decreased as the heating value or fuel value of recycled off gas increases. When the heating value of such off gas is sufficient for combustion in the secondary combustion zone and for maintaining the temperature of the secondary combustion at a desired temperature, the injection of the shale oil via a shale oil sprayer 28 into the secondary combustion zone 24 near the top of the retort is discontinued. At this stage, the off gas can have a heating value from about 80 to about 100 BTU/SCF or higher. During the remainder of the retorting operation, the secondary combustion zone can be maintained by burning only the off gas of enhanced heating value in the presence of oxygen. The oxygen can be provided by an oxygen supplying gas such as air.

In the embodiment of FIG. 2, the secondary combustion zone supplies a primary combustion zone feed gas comprising combustion or flue gas together with oxygen at a high temperature. However, it will be noted that the primary combustion zone, indicated at 32, also supplies heat for advancing the retorting zone. As the primary combustion zone 32 advances, a zone of hot combusted oil shale on the trailing side of the primary combustion zone grows continuously throughout the retorting process until retorting is completed, while the secondary combustion zone can remain at a substantially constant location near the top of the retort. The upper part of the fragmented mass, therefore, stays hot during all retorting. This results in heating oil shale in the pillars and the recovery of products therefrom. This also makes carbonaceous material in the hot combusted shale on the trailing side of the primary combustion zone available for reaction with oxygen passing through the region between the secondary combustion zone and the primary combustion zone. A portion of this carbonaceous material would not have been available for reaction with oxygen if the temperature of a portion of the hot combusted oil shale had been reduced by conducting gas at atmospheric temperature through the portion of the fragmented mass containing such hot combusted oil shale.

As used herein, the term "retorted oil shale" refers to oil shale heated to a sufficient temperature to decompose kerogen in an environment substantially free of free oxygen so as to produce liquid and gaseous products and leave a solid carbonaceous residue. As used herein, the term "combusted oil shale" refers to oil shale through which a primary combustion zone has passed, the combusted oil shale having reduced carbon content due to oxidation of such carbonaceous residue. An individual particle containing oil shale can have a core of retorted oil shale and an outer "shell" of combusted oil shale. Such can occur when oxygen has diffused only part way through the particle during the time it is at an elevated temperature and in contact with an oxygen supplying gas. As used herein, the term "raw oil shale" refers to oil shale which has not been subjected to processing for decomposing kerogen in the oil shale.

The oxygen concentration of effluent gas from the secondary combustion zone can be depleted as it passes through the hot combusted oil shale between the secondary combustion zone and the primary combustion zone when carbonaceous material remains in the particles. Therefore, the primary combustion zone feed which is passed into the primary combustion zone 32 is thought to be of substantially lower oxygen concentration than would be the case in the absence of the secondary combustion zone 24 for the same rate of heat input to the retorting zone. Therefore, the rate of advance of the primary combustion zone is lower in the presence of the secondary combustion zone 24 than would be the case in the absence of a secondary combustion zone.

It is thought that there is a desirable oxygen free environment adjacent the retort wall 22 of the retort when there is a secondary combustion zone 24. This is thought to be due to the oxygen concentration of the primary combustion zone feed being substantially lower in the presence of the secondary combustion zone 24 and to the limited amount of oxygen in the gas moving through the retort adjacent the walls. Both the lower downward velocity of the primary combustion zone 32, and the lower oxygen concentration of the feed to the primary combustion zone 32, together with the maintenance of a high interfacial retort wall temperature, provide substantial recovery of oil and gas from pillars 10 adjacent the retort, as well as high recovery of shale oil from the fragmented permeable mass in the retort. Additionally, as the products from the pillars enter the retort, they are conducted downwardly along the walls. A portion of the product can contact oxygen being conducted along the same portion of the retort. Therefore, product from the pillar entering the retort in excess of the amount which is oxidized can be conducted along the wall and through the retorting zone without being consumed.

A primary combustion zone can be established by any known method such as, for example, a method described in the aforementioned U.S. Pat. No. 3,661,423 or U.S. patent application Ser. No. 772,760 filed Feb. 28, 1977 by me now abandoned and assigned to the assignee of this application, and incorporated herein by this reference. In establishing a primary combustion zone by the method described in my '760 application, an ignition mixture is introduced into the retort through a conduit and ignited in the retort for heating oil shale to a sufficient temperature to sustain combustion.

Once a self-sustaining primary combustion zone is formed, a secondary combustion zone can be formed by introducing a retort inlet mixture or feed into the retort on the trailing side of the primary combustion zone. The retort feed contains fuel and more than sufficient oxygen supplying gas for oxidation of the fuel. The retort feed has a spontaneous ignition temperature less than the temperature in the primary combustion zone and preferably less than the temperature at the selected location where it is introduced. Thus, when introduced into the retort, the fuel in the retort inlet mixture is oxidized by the oxygen in the retort feed. The oxidation of the fuel liberates heat and establishes a secondary combustion zone in the fragmented mass. The gaseous mixture resulting from introducing the retort inlet mixture into the retort and burning the fuel in the secondary combustion zone feed contains oxidation products of fuel such as carbon dioxide and water vapor, non-reactive components of the oxygen supplying gas such as nitrogen when air is the oxygen supplying gas, carbon dioxide from decomposition of inorganic carbonates, and oxygen contained in the retort feed beyond that required for oxidation of the fuel. Heat from the secondary combustion zone is supplied to the fragmented mass on the trailing side of the primary combustion zone by the primary combustion zone feed. The fragmented mass in a gas flow path between the secondary combustion zone and the primary combustion zone is maintained at an elevated temperature approaching the temperature of the secondary combustion zone, i.e., above about 900° F.

Preferably the secondary combustion zone is maintained at a temperature of at least about 1150° F. for thermal decomposition of alkaline earth metal carbonates present in oil shale at an appreciable rate. Such thermal decomposition results in release of carbon dioxide and formation of the corresponding alkaline earth metal oxide. Oil shale contains appreciable amounts of alkaline earth metal carbonates such as magnesium carbonate and calcium carbonate. Complete decomposition of calcium carbonate to carbon dioxide and calcium oxide occurs at a temperature of about 1517° F.

It is believed that carbon dioxide released by decomposition of alkaline earth metal carbonates can react with residual carbonaceous material within a formation particle according to the reaction:

$$C+CO_2 \rightarrow 2CO \quad (1)$$

The carbon monoxide therein formed can react with oxygen in the retort inlet mixture according to the following reaction:

$$2CO+O_2 \rightarrow 2CO_2 \quad (2)$$

By these reactions, residual carbonaceous material in combusted oil shale which might be left unrecovered can be oxidized with liberation of heat which can be used for retorting oil shale in a retorting zone on the advancing side of the primary combustion zone.

To cause the primary combustion zone to advance through the retort, the rate of introduction of the retort feed into the retort is at least sufficient to generate a primary combustion zone feed at a superficial volumetric rate of 0.1 SCFM per square foot of cross-sectional area of the fragmented permeable mass being retorted. Preferably the primary combustion zone advances through the fragmented mass at a rate of at least about 0.5 feet per day to produce hydrocarbon products at a sufficiently fast rate to justify the capital investment required for retorting oil shale. At rates of advancement higher than 2 feet per day of the primary combustion zone, hydrocarbon yield per ton of oil shale being retorted can be adversely affected due to oxidation of hydrocarbon products. Therefore, preferably the primary combustion zone is advanced through the fragmented mass at a rate of up to about 2 feet per day to avoid significant yield losses.

To cause the primary combustion zone to advance through the retort at an economical rate of from about 0.5 to 2 feet per day, depending on the kerogen content of the oil shale through which the primary combustion zone is advancing, the retort feed is introduced into the retort at a rate sufficient to generate from about 0.5 to about 1 SCFM of primary combustion zone feed per square foot of the cross-sectional area of the fragmented permeable mass being retorted. Introduction of retort inlet mixture into the retort at a rate generating more than about 2 SCFM of primary combustion zone feed per square foot of cross-sectional area may result in a portion of the oxygen in the primary combustion zone feed being carried through an established or desired primary combustion zone location and into the retorting zone. In the retorting zone, such oxygen can burn hydrocarbon products and unretorted carbonaceous material in the oil shale. Therefore, it is preferred to introduce the retort feed into the retort at a rate sufficient to generate less than about 2 SCFM of the primary combustion zone feed per square foot of cross-sectional area of the fragmented permeable mass.

The oxygen concentration of the gaseous primary combustion zone feed is preferably maintained greater than about 10% by volume on a dry basis of the primary combustion zone feed to maintain the temperature in the primary combustion zone at a temperature above the retorting temperature of oil shale. Therefore, the sufficient oxygen supplying gas is provided in the retort feed to oxidize the fuel in the retort feed and produce a primary combustion zone feed which contains at least 10% oxygen by volume on a dry basis. At an oxygen concentration greater than about 20% by volume on a dry basis of the primary combustion zone feed, contact of the primary combustion zone feed with regions of high concentration of carbonaceous material in the retort can cause localized fusion of the fragmented mass of oil shale particles. Fusion of the fragmented mass can restrict the movement of gases through the retort. Therefore, it is preferred to use a retort inlet mixture having sufficient oxygen to form a gaseous primary combustion zone feed having from about 10% to about 20% oxygen by volume on a dry basis.

Maintenance of the oxygen concentration at less than about 15% by volume on a dry basis of the gaseous primary combustion feed provides a margin of safety to prevent fusion of the mass of particles. At an oxygen concentration of at least 10% by volume on a dry basis of the gaseous primary combustion zone feed, the maximum temperature in the primary combustion zone can readily be adjusted to a desired temperature above the retorting temperature of the oil shale. Therefore, the use of a retort inlet mixture containing sufficient oxygen to form a gaseous primary combustion zone feed having from about 10% to about 15% oxygen by volume on a dry basis constitutes a preferred embodiment.

The concentration of oxygen in the retort inlet mixture depends upon such factors as the volume of primary combustion zone feed desired to be generated per square foot of cross-sectional area of the fragmented permeable mass being retorted, the desired temperature in the primary combustion zone, and the amount of residual carbonaceous material left in the shale after retorting. A lower concentration of oxygen is needed in the primary combustion zone feed as the volumetric flow rate of the primary combustion zone feed increases, as the desired temperature in the primary combustion zone decreases, and as the concentration of residual carbonaceous material in the retorted oil shale increases. Conversely, a higher concentration of oxygen is required in the primary combustion zone feed at lower volumetric flow rates of the gaseous primary combustion zone feed, higher desired primary combustion zone temperatures, and lower concentrations of residual carbonaceous material.

The desired concentration of oxygen in the primary combustion zone feed is dependent upon the concentration of residual carbonaceous material in the retorted oil shale because the more carbonaceous material present, the more heat which can be generated per unit volume of spent shale. Thus, it is advantageous to know the concentration of carbonaceous material available for combustion in various regions throughout the retort. Concentration of carbonaceous material available for combustion can be estimated by conducting assays of core samples taken at various regions and strata of the retort. Generally, the higher the concentration of kerogen in a region of a retort, the higher will be the concentration of residual carbonaceous material for combustion in the retorted shale.

The fuel for the retort feed can be a gaseous fuel such as post-retorting gas from an in situ oil shale retort, rich off gas having a heating value of at least about 80 BTU/SCF (British thermal units per standard cubic foot) from an active in situ oil shale retort, butane, propane, natural gas, liquefied petroleum gas, or the like; a liquid fuel such as shale oil, crude petroleum oil, diesel fuel, alcohol, or the like; a comminuted solid fuel such as coal; and mixtures thereof.

Post-retorting gas is gas generated during a post-retorting operation. As used herein, the term "post-retorting operation" refers to a period at the end of normal retorting operation; that is, it refers to a period after a retorting zone has advanced through substantially all of the fragmented permeable mass in the retort. Generation of post-retorting gas by a post-retorting operation is described in U.S. Patent Application Ser. No. 763,155 filed on Jan. 22, 1977, assigned to the assignee of this invention, and incorporated here by this reference.

The retort inlet mixture requires a heating value of at least about 22 BTU/SCF to maintain a secondary combustion zone having a temperature of 1200° F., i.e., a secondary combustion sufficiently hot to efficiently retort oil shale in unfragmented formation of the boundaries of the retort. When air is the source of oxygen of the retort inlet mixture, the retort inlet mixture must contain at least about two parts by volume air per one part by volume retorting off gas to produce a primary combustion zone feed containing 10% oxygen by volume. About two parts by volume air per part by value off gas are required rather than 1 part by volume air per 1 part by volume off gas because a portion of the oxygen of the retort inlet mixture is consumed by reaction with combustible components of retorting off gas. Therefore, to have a secondary combustion zone having a temperature of 1200° F. where retorting off gas is the fuel, the retorting off gas must have a heating value of at least about 66 BTU/SCF.

When retorting off gas is used as the fuel of the retort inlet mixture, preferably it has a heating value of at least about 80 BTU/SCF to consistently maintain a secondary combustion zone having a temperature of 1200° F. An off gas of such a high heating value has not been achieved by conventional techniques, where after establishment of a combustion zone in the fragmented mass, retorting off gas is used to dilute introduced air. According to the present invention, off gas having a heating value of 80 BTU/SCF is obtained by first operating a retort using a fuel other than off gas in the retort inlet mixture. As retorting progresses, this results in generation of off gas having a heating value of at least 80 BTU/SCF, which can then be used as at least a portion of the fuel of the retort inlet mixture.

Preferably, a liquid fuel is used in the retort inlet mixture because liquid fuels are readily available and easily transported. In addition, liquid fuels have a lower volume per BTU than gaseous fuels. Therefore, the pressure drop across the fragmented mass in a retort with a liquid fuel is less than the pressure drop with a gaseous fuel supplying an equivalent amount of heating value.

Low pressure drop across the fragmented mass is important inasmuch as retorting may be continued for an extensive period of time. For example, one experimental in situ retort a little over 80 feet high was retorted over a period of 120 days. If there is a high pressure drop along the length of the fragmented mass, blowers or compressors used for inducing gas flow will operate at relatively high pressure (for example 5 psig), which requires appreciably more energy for driving the blowers or compressors than if the pressure drop is relatively low. The total energy requirements can be relatively high because of the long time required for retorting. Higher pressure operation also can take a greater capital expenditure for blowers or compressors, and some gas leakage from the retort can occur, further reducing efficiency.

The preferred liquid fuel is shale oil which has been withdrawn from an in situ oil shale retort because it is readily available and has little, if any, value added by processing.

Oxygen for the retort inlet mixture can be provided by oxygen supplying gases such as air or air mixed with oxygen or air mixed with a diluent to reduce the oxygen concentration of the mixture.

Beneficial effects can be obtained from the presence of water in the primary combustion zone feed.

Beneficial effects of providing a retort inlet mixture containing water vapor and oxygen are discussed in U.S. Pat. No. 4,036,299. This patent is incorporated herein by this reference.

Therefore, preferably the retort inlet mixture contains water vapor and/or liquid water. To obtain significant beneficial effects of the presence of matter in the retort, preferably the primary combustion zone feed contains at least about 10% by volume water vapor. In forming the retort inlet mixture, allowance should be made for water resulting from oxidation of any hydrogen containing compounds present in the retort inlet mixture, connate water, and leakage of water into the retort from underground aquifers.

The water in the retort inlet mixture can be a portion of water withdrawn from an in situ oil shale retort. This is an advantageous use of such water since it can contain some hydrocarbon products of retorting and inorganic materials and therefore could require treatment before release to the environment. When such water is used in the process, treatment is not required. Water containing impurities from other sources such as boiler blow down and sewage can be used as the source of water.

In a preferred embodiment, fuel and an oxygen supplying gas are substantially homogeneously mixed prior to introduction into the retort as a retort feed. This can be accomplished by any number of methods. For example, when the fuel is a liquid, such as shale oil, the fuel can be dispersed in the oxygen supplying gas by means of a venturi gas/liquid contactor or similar device. When the fuel is a gaseous fuel, the oxygen supplying gas and gaseous fuel can be mixed by means of an injection nozzle. Water or steam in the retort inlet mixture can also be homogeneously mixed with the fuel and the oxygen supplying gas prior to introduction to the retort.

The gaseous primary combustion zone feed is formed and introduced into the primary combustion zone at a rate sufficient to maintain the maximum temperature in the primary combustion zone at a temperature above the retorting temperature of the oil shale and to advance the primary combustion zone through the in situ oil shale retort.

The upper limit on the temperature in the primary and secondary combustion zones is determined by the fusion temperature of the oil shale, which is about 2100° F. The temperature in the primary and secondary combustion zones preferably is maintained below about 1800° F. to provide a margin of safety between the temperature in the primary and secondary combustion zones and the fusion temperature of the oil shale. In this specification, when temperature of a primary or secondary combustion zone is mentioned, reference is being made to the maximum temperature in the combustion zone.

Retorting of oil shale can be carried out with primary combustion zone temperatures as low as about 800° F. However, in order to have retorting at an economically fast rate, it is preferred to maintain the primary combustion zone above about 900° F.

In one embodiment of this invention, a plurality of in situ oil shale retorts each containing a fragmented permeable mass of particles containing oil shale, is formed with pillars of oil shale providing walls between adjacent retorts. The amount of oil shale deposit remaining between retorts is about 30% of the entire formation prepared for in situ retorting. The kerogen assay of the fragmented shale in the retort is about the same as the kerogen assay of the shale in the pillars adjacent to the retorts.

During the initial stage of retorting, wall temperatures of the order of 900° F. are developed at the interface of the fragmented permeable mass at the top of the retort and the pillars. Shale oil produced during the initial stages of retorting is collected at the bottom of the retort. A portion of the shale oil is mixed with air and is fed into the top of each retort. This mixture of shale oil and air is ignited at the top of the retorts for establishing a secondary combustion zone near the top of the retorts. This secondary combustion zone maintains wall temperatures at the top of the retort between about 1000° F. and about 1200° F. The secondary combustion zone can be identified by measuring the temperature and oxygen concentration of gases near the top of the retort. As the retorting continues, both the primary combustion zone and the retorting zone move downward.

As retorting continues, the richness or heating value of the retort off gas increases. This may be due to an increase in the gas production rate from the pillars. Such off gas is rich in hydrocarbons with high heating value. When the heating value of the retort off gas is sufficient for combustion in the secondary combustion zone and maintaining the temperature in the secondary combustion zone at about 1200° F., the injection of the shale oil is discontinued and only recycled off gas of sufficient heating value is introduced into the retort and burned in the secondary combustion zone therein, said secondary combustion zone being maintained thereafter only by combustion of such recycled off gas. Combustible retort off gas from another retort can also be used as fuel.

Upon completion of the retorting operation, the amount of oil recovered is about 85% to about 95% of the maximum oil recoverable from the fragmented permeable mass of oil shale, exclusive of the oil which is recycled and burned in the secondary combustion zone. Oil recovery from substantially the same grade oil shale which is retorted and without establishing a secondary combustion zone with wall temperature of about 1000° F. is substantially less, of the order of about 60% to about 80% of the maximum oil recoverable from the fragmented permeable mass of oil shale.

Gases are passed from the secondary combustion zone into the primary combustion zone at a rate sufficient to maintain the maximum temperature in the primary combustion zone at a temperature above the retorting temperature of oil shale and to advance the primary combustion zone through the in situ oil shale retort. In the primary combustion zone, residual carbonaceous material in the retorted oil shale is believed to be oxidized to yield carbon dioxide according to reactions (1) and (2) above and the reaction:

$$C+O_2 \rightarrow CO_2 \quad (3)$$

Reactions (2) and (3), which are exothermic generate heat required for the endothermic retorting of kerogen in the oil shale in the retorting zone. Carbon dioxide produced by carbonate decomposition within a large oil shale particle can react with residual carbonaceous material contained therein by reaction (1). Also, carbon dioxide generated by oxidation of fuel for generation of a hot primary combustion zone feed can react with residual carbonaceous material contained in oil shale particles by reaction (1).

When carbonaceous material in the retort is at a sufficiently high temperature, water vapor can react by the water gas reaction:

$$H_2O+C \rightarrow H_2+CO \quad (4)$$

or by its equivalent:

$$n\ H_2O+C_nH_{n+2} \rightarrow (n+1)H_2+nCO \quad (5)$$

The water gas reaction is believed to occur when water contacts carbonaceous material heated to a temperature above about 1200° F. It is thought that the residual carbonaceous material remaining in retorted oil shale is in a highly active form and the water gas reaction can occur at a temperature as low as about 1000° to 1100° F.

Carbon monoxide generated by the water gas reaction can be oxidized by oxygen in the combustion zone feed according to reaction (2) and hydrogen generated by the water gas reaction can be oxidized according to the reaction:

$$2H_2+O_2 \rightarrow 2H_2O \quad (6)$$

Carbon monoxide can also be oxidized by the reaction:

$$CO+H_2O \rightarrow CO_2+H_2 \quad (7)$$

Although the water gas reaction is endothermic, reactions (2), (3), and (6) are exothermic. The net result of reactions (2), (4) and (6) is the oxidation of carbon to carbon dioxide with regeneration of the water used in the water gas reaction by reaction (6).

Utilizing the water gas reaction for oxidation of residual carbonaceous material is a reason for maintaining the secondary combustion zone at a temperature of at least about 1150° F.

Oil shale is a poor heat conductor, and therefore, heat generated in a region in an in situ oil shale retort tends to remain within the region and increase the temperature of oil shale within the region. However, with the method described herein, gases are moved through the primary combustion zone in the direction of advancement of the primary combustion zone through the retort. The gaseous mixture passing from the primary combustion zone into the retorting zone contains combustion gas generated in the primary combustion zone and any gaseous unreacted portion of the retort inlet mixture. This gas stream provides the heat required for the endothermic retorting of the kerogen in the oil shale particles.

Retorting of the oil shale in the retorting zone produces gaseous and liquid products such as carbon dioxide, carbon monoxide, hydrogen, hydrogen sulfide, water liberated from the shale, and hydrocarbons such as methane, ethane, and shale oil. Raw oil shale on the advancing side of the retorting zone is at the ambient temperature of the oil shale prior to establishing the combustion zone in the retort and gradually increases in temperature as the retorting zone approaches. Some of the raw oil shale is below the dew point of gas on the advancing side of the retorting zone. Thus, water, if any, introduced into the retort as part of the retort inlet mixture and any water released from the oil shale can condense on raw oil shale. Such condensed water percolates to the bottom of the fragmented mass and is collected in the sump 20 as a portion of the liquid products. Also collected in the sump are hydrocarbons produced in the retorting zone which condense above ambient temperature. The uncondensed gaseous products, combustion gas from the combustion zone, carbon dioxide from carbonate decomposition, and any gaseous unreacted portion of the retort inlet mixture are withdrawn from the bottom of the retort in the off gas stream. The off gas stream can be saturated with water vapor.

A method of in situ retorting with a secondary combustion zone has significant advantages compared to a method of retorting oil shale without a secondary combustion zone. Among these advantages is increased yield of liquid hydrocarbons. It is believed that enhanced yields can be obtained because residual carbonaceous material in oil shale on the trailing side of the primary combustion zone is maintained at a temperature higher than its spontaneous ignition temperature. Thus, this residual carbonaceous material can react with oxygen in the retort inlet mixture. Also, high temperatures in the combusted oil shale on the trailing side of the primary combustion zone increases the diffusivity of oxygen and water vapor into oil shale, thereby resulting in oxidation of residual carbonaceous material in large formation particles containing oil shale which otherwise might not react with oxygen. Furthermore, carbon dioxide produced by carbonate decomposition in large particles of oil shale can react with residual carbonaceous material by reaction (1) and generate heat by reaction (2) to provide additional heat for retorting of kerogen in the retorting zone. Thus, enhanced yields of hydrocarbon products can be obtained because residual carbonaceous material which otherwise might not have reacted with oxygen is used to produce the energy required for retorting, thereby allowing kerogen in the retorting zone to be retorted, rather than being oxidized to generate energy required for retorting.

Also contributing to enhanced yields obtained by operating a retort with a secondary combustion zone is that kerogen in unfragmented formation adjacent the retort and kerogen bypassed by the retorting zone and primary combustion zone, such as kerogen in oil shale in the upper corners of the retort, can produce hydrocarbon products. This kerogen otherwise might not have been retorted.

Another advantage of retorting with a secondary combustion zone is enhancement of the fuel value or heating value of the retort off gas. In retort operations utilizing a gaseous feed comprising air and recycled retort off gas, and having a temperature about the same as ambient temperature, the heating value of the retort off gas is relatively low, i.e., in the order of about 20 to 60 BTU/SCF on a dry basis. This retort off gas is of marginal value, if usable at all, for use in a work engine to generate power, and if it is used, it may be necessary to augment the retort off gas with other combustible material. It is found that when the retort inlet mixture contains fuel for establishing and maintaining a secondary combustion zone, an off gas with a heating value of from about 50 to about 100 BTU/SCF or higher can be obtained. At such heating value the off gas is satisfactory for combustion in a work engine such as a gas turbine. Relatively high heating value off gas, i.e., off gas having a heating value of 80 BTU/SCF or higher, can be used as at least part of the fuel of the retort inlet mixture.

It is believed that this improvement in the heating value of the off gas is attributable to the fact that inclusion of fuel in retort inlet mixture results in introduction of less non-combustibles into the retort than inclusion of recycled off gas in the retort inlet mixture. Both fuel and recycled off gas can be used to reduce the oxidation concentration of air to a value from a primary combustion zone feed having an oxygen concentration of 10 to 15% by volume. Fuel does this primarily by consuming oxygen. Retort off gas does this primarily by diluting the air with non-combustible components of the off gas; off gas can contain more than 80% by volume carbon dioxide and nitrogen. Thus, use of fuel in the retort inlet mixture in place of recycled off gas results in introduction of less non-combustibles into the retort, and therefore off gas withdrawn from the retort contains less non-combustibles. Furthermore, the bulk of water vapor produced from oxidation of fuel of the retort inlet mixture does not appear in the off gas from the retort, but instead is condensed on the shale on the advancing side of the retorting zone and is withdrawn as liquid with the condensed hydrocarbon products. Condensation of the water vapor removes an inert diluent from the off gas, enhancing its fuel value on a volumetric dry basis.

An advantage of retorting with a secondary combustion zone where the fuel is a liquid fuel or a rich gaseous fuel of high heating value, such as hydrogen, methane, propane, natural gas, or liquefied petroleum gas, is that there is less pressure drop across the fragmented mass than when retorting off gas is used in the retort inlet mixture. This is because when retorting off gas is used to dilute air of the retort inlet mixture, the presence of non-combustible constituents of the retorting off gas results in a primary combustion zone feed having a higher volumetric flow rate per square foot of retort cross-sectional area than the volumetric flow rate of the air introduced to the retort. On the other hand, when the fuel of the retort inlet mixture is a liquid fuel or a rich gaseous fuel, the volume at standard temperature and pressure (STP) of the primary combustion zone feed on a dry basis is less than the volume (STP) of the introduced air. This occurs because fuel of the retort inlet mixture reacts with oxygen of the air to produce carbon dioxide, carbon monoxide and water. Even on a wet basis, the volume (STP) of the oxidation products of the fuel in combination with the nonreacted components of the introduced air can be less than 10% greater than the volume (STP) of the introduced air.

Therefore, use of a liquid fuel and/or a rich gaseous fuel as the fuel of the retort inlet mixture rather than recycled off gas results in a lower volumetric flow rate of gas through the retort. Thus, the pressure drop across the retort is smaller, which reduces the size of blowers required for retorting and reduces the energy cost associated with passing gases through the fragmented mass.

In one embodiment of this invention, a secondary combustion zone is established in a substantially square in situ oil shale retort having sides measuring about 120 feet wide and having a height of about 270 feet and containing a fragmented permeable mass of particles containing oil shale. A primary combustion zone is established at the top of the retort and is advanced downwardly through the retort, leaving a hot fragmented permeable mass of particles on the trailing side of the primary combustion zone and producing shale oil. While a portion of the fragmented permeable mass of particles near the top of the retort is still at a temperature greater than about 900° F., a secondary combustion zone is established at the top of the retort.

The secondary combustion zone is formed by introducing air at the rate of 7,900 SCFM, water at the rate of 3.48 gallons per minute and shale oil at the rate of 1.32 gallons per minute into the top of the retort. The shale oil is shale oil produced in the retort or another retort. An atomizer is used for mixing the shale oil and water with the air just prior to introducing the air into the retort. The shale oil is oxidized when heated to its spontaneous ignition temperature at the top of the retort to form the secondary combustion zone. The water vaporizes on being heated and is conducted along with the gases resulting from the oxidation of the shale oil and the remaining portions of the air into the primary combustion zone. These gases are conducted into the primary combustion zone at a superficial velocity of about 0.62 SCFM per square foot of the fragmented mass being retorted and with oxygen and water vapor concentrations of about 14.7 and 10.2 percent by volume, respectively. The net shale oil recovery from the retort is about 72.% of Fischer assay.

Although this invention has been described in considerable detail with reference to certain versions thereof, other versions are within the scope of this invention. For example, although the invention has been described in terms of a single in situ oil shale retort containing a primary combustion zone, a secondary combustion zone, and a retorting zone, it is possible to practice this invention with two serially connected retorts. The first retort can contain retorted oil shale and both combustion zones. The gases generated in the primary combustion zone of the first retort would be passed to a second retort for retorting raw oil shale contained therein.

In addition, although FIG. 2 shows a retort where the combustion and retorting zones are advancing downwardly through the retort, this invention is also useful for retorts where the combustion and retorting zones are advancing upwardly or transverse to the vertical.

Furthermore, although the invention has been described with water, the source of oxygen, and the fuel comprising a retort inlet mixture being introduced together and continuously into a retort, these three components of the inlet mixture can be introduced intermittently and/or independently into the retort.

Because of variations such as these, the spirit and scope of the appended claims should not necessarily be limited to the description of the preferred versions contained herein.

What is claimed is:

1. A method of recovering liquid and gaseous products from an in situ oil shale retort in a subterranean formation containing oil shale, said in situ oil shale retort containing a fragmented permeable mass of particles containing oil shale and having a primary combustion zone and a retorting zone advancing therethrough, the fragmented mass having gas flow paths therethrough, which comprises the steps of:

introducing into the in situ oil shale retort on the trailing side of the primary combustion zone, a retort inlet mixture comprising fuel and oxygen supplying gas;

controlling the composition of the retort inlet mixture such that it contains sufficient oxygen to oxidize the fuel for forming a secondary combustion zone and for forming a primary combustion zone feed containing at least 10% by volume oxygen on a dry basis, such that the retort inlet mixture has a spontaneous ignition temperature lower than the temperature of the primary combustion zone, and such that the retort inlet mixture comprises sufficient fuel for maintaining the temperature of the secondary combustion zone and the temperature of a portion of the fragmented mass in a gas flow path between the primary and secondary combustion zones above a sufficient temperature for reaction of oxygen with residual carbonaceous material in retorted oil shale;

passing the primary combustion zone feed into the primary combustion zone for advancing the primary combustion zone through the fragmented mass of particles and produce primary combustion gas;

passing said primary combustion gas and any unreacted gaseous portion of the retort inlet mixture through a retorting zone in the fragmented mass of particles on the advancing side of the primary combustion zone whereby oil shale is retorted and gaseous and liquid products are produced; and withdrawing liquid products and retort off gas comprising such gaseous products, primary combustion gas and any gaseous unreacted portion of the retort inlet mixture from the in situ oil shale retort on the advancing side of the retorting zone.

2. The method of claim 1 wherein the fuel of the retort inlet mixture comprises post-retorting gas withdrawn from an in situ oil shale retort.

3. The method of claim 1 wherein the fuel of the retort inlet mixture comprises shale oil withdrawn from an in situ oil shale retort.

4. The method of claim 1 wherein the retort has boundaries of unfragmented formation and at least a portion of the unfragmented formation adjacent the secondary combustion zone is maintained at a temperature higher than about 900° F.

5. The method of claim 1 wherein the retort has boundaries of unfragmented formation and at least a portion of the unfragmented formation adjacent the secondary combustion zone is maintained at a temperature higher than about 1200° F.

6. The method of claim 1 wherein the fuel of the retort inlet mixture comprises diesel fuel.

7. The method of claim 1 wherein the secondary combustion zone is formed near the top of the in situ oil shale retort and the primary combustion zone is advanced downwardly through the fragmented mass.

8. The method of claim 7 wherein the secondary combustion zone is maintained near the top of the in situ oil shale retort.

9. The method of claim 1 wherein the retort inlet mixture has a heating value of at least about 22 BTU/SCF.

10. The method of claim 1 wherein the retort inlet mixture comprises steam.

11. A method for forming a secondary combustion zone in an in situ oil shale retort having boundaries of unfragmented formation and containing a fragmented permeable mass of particles containing oil shale and having a primary combustion zone advancing therethrough, which comprises the steps of:

introducing a retort inlet mixture comprising: (a) a fuel selected from the group consisting of shale oil and products thereof, diesel fuel, butane, propane and mixture thereof and (b) more than sufficient oxygen supplying gas for oxidizing the fuel, into a selected location in the fragmented mass on the trailing side of the primary combustion zone; and controlling the composition of the retort inlet mixture so the spontaneous ignition temperature of the retort inlet mixture is less than the temperature in the primary combustion zone and less than the temperature of said selected location, such that a secondary combustion zone is formed at said selected location.

12. The method of claim 11 wherein at least a portion of the boundaries of unfragmented formation adjacent the secondary combustion zone is maintained at a temperature above the retorting temperature of oil shale.

13. The method of claim 11 wherein at least a portion of the boundaries of unfragmented formation adjacent the secondary combustion zone is maintained at a temperature higher than about 900° F.

14. The method of claim 11 wherein at least a portion of the boundaries of unfragmented formation adjacent the secondary combustion zone is maintained at a temperature higher than about 1200° F.

15. The method of claim 11 wherein the secondary combustion zone is formed near the top of the in situ oil shale retort and the primary combustion zone is advanced downwardly through the retort.

16. The method of claim 11 wherein the retort inlet mixture comprises steam.

17. A method for recovering liquid and gaseous products from unfragmented subterranean formation containing oil shale adjacent a fragmented permeable mass of particles containing oil shale in an in situ oil shale retort, comprising the steps of:

advancing a primary combustion zone through the fragmented permeable mass of particles;

establishing a secondary combustion zone in the fragmented permeable mass of particles on the trailing side of the primary combustion zone for supplying heat to unfragmented formation adjacent such fragmented permeable mass of particles after passage of the primary combustion zone; and maintaning the secondary combustion zone at a sufficiently high temperature that the quantity of heat supplied by the secondary combustion zone is sufficient to maintain at least a portion of unfragmented formation adjacent the secondary combustion zone at a temperature of at least about 900° F. to retort shale oil therefrom.

18. The method of claim 17 wherein at least a portion of unfragmented formation adjacent the secondary combustion zone is maintained at a temperature higher than about 1200° F.

19. The method of claim 17 wherein the secondary combustion zone is established near the top of the in situ oil shale retort and the primary combustion zone is advanced downwardly through the fragmented mass.

20. The method of claim 17 wherein the secondary combustion zone is maintained near the top of the in situ oil shale retort.

21. A method of increasing the yield of hydrocarbon products from a fragmented permeable mass of particles containing oil shale in an in situ oil shale retort, wherein an oxygen supplying gas is introduced into the in situ oil shale retort for advancing a primary combustion zone through the fragmented mass in the in situ oil shale retort such that a hot fragmented permeable mass of particles resulting from the movement of the primary combustion zone through the in situ oil shale retort remains in the in situ oil shale retort on the trailing side of the primary combustion zone; which comprises the steps of:

establishing a secondary combustion zone in the in situ oil shale retort on the trailing side of the primary combustion zone, there being at least one gas flow path from the secondary combustion zone to the primary combustion zone through the fragmented mass; and maintaining the secondary combustion zone such that heat from the secondary combustion zone is supplied to the fragmented permeable mass of particles in the in situ oil shale retort on the trailing side of the primary combustion zone for maintaining the temperature of fragmented mass in a gas flow path between the secondary combustion zone and the primary combustion zone above about 900° F.

22. The method of claim 21 wherein the secondary combustion zone is established by supplying a combustible retort inlet mixture having a spontaneous ignition temperature less than about 900° F. to the fragmented permeable mass of particles at a location on the trailing side of the primary combustion zone, said location having a temperature of at least about 900° F.

23. The method of claim 22 wherein the retort inlet mixture comprises off gas from an in situ oil shale retort having a heating value of greater than about 80 BTU/SCF and oxygen supplying gas.

24. The method of claim 23 wherein the retort inlet mixture has a heating value of at least about 22 BTU/SCF.

25. The method of claim 22 wherein the retort inlet mixture comprises diesel fuel and oxygen supplying gas.

26. The method of claim 22 wherein the retort inlet mixture comprises post-retorting gas and air.

27. The method of claim 22 wherein the secondary combustion zone is established near the top of the in situ oil shale retort and the primary combustion zone is advanced downwardly through the fragmented mass.

28. The method of claim 27 wherein the secondary combustion zone is maintained near the top of the in situ oil shale retort.

29. The method of claim 22 wherein the retort inlet mixture has a heating value of at least about 22 BTU/SCF.

30. The method of claim 22 wherein the retort inlet mixture comprises fuel and an excess of oxygen over that needed to oxidize the fuel.

31. The method of claim 22 wherein the retort inlet mixture comprises steam.

32. The method of claim 22 wherein the retort inlet mixture comprises shale oil and oxygen supplying gas.

33. The method of claim 32 wherein the retort inlet mixture comprises steam.

34. A method for retorting oil shale in an in situ oil shale retort in a subterranean formation containing oil shale, the retort containing a fragmented permeable mass of formation particles containing oil shale, comprising the steps of:

establishing a primary combustion zone in the fragmented mass;

introducing a primary combustion zone feed containing oxygen into the primary combustion zone for advancing the primary combustion zone through the fragmented mass;

establishing a secondary combustion zone at a location in the fragmented mass on the trailing side of the primary combustion zone; and introducing a retort inlet mixture containing sufficient fuel and oxygen into the secondary combustion zone for maintaining the secondary combustion zone at substantially the same location in the fragmented mass and for forming such a primary combustion zone feed containing oxygen for advancing the primary combustion zone through the fragmented mass.

35. The method of claim 34 wherein the fuel comprises shale oil.

36. The method of claim 34 wherein the fuel comprises post-retorting gas.

37. The method of claim 34 wherein the primary combustion zone feed contains at least about 10% by volume on a dry basis oxygen.

38. The method of claim 34 wherein the primary combustion zone feed comprises steam.

39. A method for forming a secondary combustion zone in an in situ oil shale retort containing a fragmented permeable mass of particles containing oil shale and having a primary combustion zone advancing therethrough, which comprises the step of:

introducing a retort inlet mixture comprising a liquid fuel and oxygen supplying gas into a selected location in the fragmented mass on the trailing side of the primary combustion zone, such that a secondary combustion zone is formed at said selected location.

40. The method of claim 39 wherein the fuel is shale oil.

41. The method of claim 39 wherein the fuel is diesel fuel.

42. The method of claim 39 wherein the retort has boundaries of unfragmented formation and at least a portion of the boundaries of unfragmented formation adjacent the secondary combustion zone is maintained at a temperature above the retorting temperature of oil shale.

43. The method of claim 39 wherein the secondary combustion zone is formed near the top of the in situ oil shale retort and the primary combustion zone is advanced downwardly through the retort.

44. The method of claim 39 wherein the retort inlet mixture comprises an excess of oxygen over that needed to oxidize the fuel.

45. The method of claim 39 wherein the retort inlet mixture comprises steam.

46. A method for forming a secondary combustion zone in an in situ oil shale retort containing a fragmented permeable mass of particles containing oil shale and having a primary combustion zone advancing therethrough, which comprises the steps of:

introducing a retort inlet mixture comprising a gaseous fuel having a heating value of greater than about 80 BTU/SCF and an excess of oxygen over that needed to oxidize the fuel into a selected location in the fragmented mass on the trailing side of the primary combustion zone such that a secondary combustion zone is formed at said selected location.

47. The method of claim 46 wherein the fuel of the retort inlet mixture comprises post-retorting gas withdrawn from an in situ oil shale retort.

48. The method of claim 46 wherein the fuel of the retort inlet mixture comprises off gas withdrawn from an in situ oil shale retort.

49. The method of claim 46 wherein the retort inlet mixture comprises steam.

50. A method of forming a secondary combustion zone in an in situ oil shale retort having walls and containing a fragmented permeable mass of particles containing oil shale and having a primary combustion zone advancing therethrough, which comprises the steps of:

introducing a retort inlet mixture comprising fuel and oxygen supplying gas for oxidizing the fuel, the retort inlet mixture having a spontaneous ignition temperature lower than the temperature in the primary combustion zone, into a location in the fragmented mass on the trailing side of the primary combustion zone, said location having a temperature higher than the spontaneous ignition temperature of the retort inlet mixture, wherein at least a portion of the retort walls adjacent the secondary combustion zone is maintained at a temperature higher than about 900° F.

51. The method of claim 50 in which the fuel of the retort inlet mixture comprises shale oil withdrawn from an in situ oil shale retort.

52. The method of claim 50 wherein at least a portion of the retort walls adjacent the secondary combustion zone is maintained at a temperature higher than about 1200° F.

53. The method of claim 50 wherein the secondary combustion zone is formed near the top of the in situ oil shale retort and the primary combustion zone is advanced downwardly through the fragmented mass.

54. The method of claim 50 wherein the retort inlet mixture comprises steam.

55. A method for recovering liquid and gaseous products from subterranean formation containing oil shale adjacent a fragmented permeable mass of particles containing oil shale in an in situ oil shale retort, the subterranean formation adjacent the retort providing walls for the retort, comprising the steps of:

advancing a primary combustion zone through the fragmented permeable mass of particles; and maintaining a secondary combustion zone in the fragmented permeable mass of particles on the trailing side of the primary combustion zone for supplying heat to the formation adjacent such fragmented permeable mass of particles after passage of the primary combustion zone, the quantity of heat supplied by the secondary combustion zone being sufficient to maintain the temperature of formation adjacent the secondary combustion zone at least high enough to retort oil shale, wherein at least a portion of the retort walls adjacent the secondary combustion zone is maintained at a temperature higher than about 900° F.

56. The method of claim 55 wherein at least a portion of the retort walls adjacent the secondary combustion zone is maintained at a temperature higher than about 1200° F.

57. The method of claim 55 wherein the secondary combustion zone is maintained near the top of the in situ oil shale retort and the primary combustion zone is advanced downwardly through the fragmented mass.

58. A method of recovering liquid and gaseous products from an in situ oil shale retort in a subterranean formation containing oil shale, said in situ oil shale retort having walls of subterranean formation and containing a fragmented permeable mass of particles containing oil shale and having a primary combustion zone and a retorting zone advancing therethrough, which comprises the steps of:

introducing into the in situ oil shale retort on the trailing side of the primary combustion zone, a retort inlet mixture comprising fuel and sufficient oxygen supplying gas for oxidizing the fuel to form a secondary combustion zone and for forming a primary combustion zone feed containing oxygen, the retort inlet mixture comprising sufficient fuel for maintaining the temperature of the secondary combustion zone and the temperature of the portion of the retort between the primary and secondary combustion zones above the retorting temperature of oil shale, wherein at least a portion of the retort walls adjacent the secondary combustion zone is maintained at a temperature higher than about 900° F.;

conducting the primary combustion zone feed into the primary combustion zone to advance the primary combustion zone through the fragmented mass of particles and produce primary combustion gas;

passing said primary combustion gas and any unreacted gaseous portion of the retort inlet mixture through a retorting zone in the fragmented mass of particles on the advancing side of the primary combustion zone whereby oil shale is retorted and gaseous and liquid products are produced; and withdrawing liquid products and retort off gas comprising said gaseous products, primary combustion gas and any gaseous unreacted portion of the retort inlet mixture from the in situ oil shale retort on the advancing side of the retorting zone.

59. The method of claim 58 in which the fuel of the retort inlet mixture comprises shale oil withdrawn from an in situ oil shale retort.

60. The method of claim 58 wherein at least a portion of the retort walls adjacent the secondary combustion zone is maintained at a temperature higher than about 1200° F.

61. The method of claim 58 wherein the secondary combustion zone is formed near the top of the in situ oil shale retort and the primary combustion zone is advanced downwardly through the fragmented mass.

62. The method of claim 58 wherein the primary combustion zone feed contains at least about 10% by volume on a dry basis oxygen.

63. The method of claim 58 wherein the primary combustion zone feed comprises steam.

64. A method of increasing the yield of carbonaceous products from pillars adjacent to a fragmented permeable mass of particles containing oil shale in an in situ oil shale retort, wherein an oxygen supplying gas is introduced into the in situ oil shale retort to move a primary combustion zone downwardly through the in situ oil shale retort such that a hot fragmented permeable mass of particles resulting from the movement of the primary combustion zone through the in situ oil shale retort remains in the in situ oil shale retort above the primary combustion zone; which comprises the steps of:

establishing a secondary combustion zone in the in situ oil shale retort above the primary combustion zone; and maintaining the secondary combustion zone such that heat from the secondary combustion zone is supplied to the fragmented permeable mass of particles in the in situ oil shale retort above the primary combustion zone and the yield of carbonaceous products from the pillars adjacent such fragmented permeable mass of particles is increased.

65. The method as recited in claim 64 wherein the secondary combustion zone is established by supplying a combustible mixture having a minimum combustion temperature lower than about 1200° F. to the fragmented permeable mass of particles at an elevation above the primary combustion zone having a temperature of greater than about 1200° F. such that a secondary combustion zone is established and maintained in the in situ oil shale retort above the primary combustion zone.

66. The method as recited in claim 65 wherein the combustible mixture is a mixture comprising shale oil and oxygen supplying gas.

67. The method as recited in claim 65 wherein the combustible mixture is a mixture comprising recycled off gas having a heating value of greater than about 80 BTU/SCF and oxygen supplying gas.

68. The method as recited in claim 65 wherein the combustible mixture is a mixture comprising shale oil, recycled off gas, and oxygen supplying gas.

69. The method of claim 65 in which the combustible mixture comprises steam.

70. The method as recited in claim 64 wherein the secondary combustion zone is established near the top of the in situ oil shale retort.

71. A method for forming a gaseous primary combustion zone feed for advancing a primary combustion zone through a fragmented permeable mass of formation particles containing oil shale in an in situ oil shale retort, comprising the steps of:

establishing a primary combustion zone in the fragmented permeable mass;

introducing air to the fragmented permeable mass on the trailing side of the primary combustion zone for advancing the primary combustion zone through the fragmented permeable mass;

introducing fuel to the fragmented permeable mass for reaction with a portion of the oxygen of the introduced air on the trailing side of the primary combustion zone for forming a primary combustion zone feed comprising up to about 15% by volume on a dry basis oxygen; and controlling the composition of introduced fuel and the proportion of the introduced fuel to the introduced air such that the volume (STP) of the primary combustion zone feed on a dry basis is less than the volume (STP) of the introduced air.

72. The method of claim 71 wherein the primary combustion zone feed contains about 15% by volume on a dry basis oxygen.

73. The method of claim 71 wherein the fuel comprises a liquid fuel.

74. The method of claim 71 wherein the fuel comprises shale oil.

75. The method of claim 71 wherein the primary combustion zone feed comprises steam.

76. A method of forming a secondary combustion zone in an in situ oil shale retort having boundaries of unfragmented formation and containing a fragmented permeable mass of particles containing oil shale and having a primary combustion zone advancing therethrough, which comprises the steps of:

introducing a retort inlet mixture comprising post-retorting gas and more than sufficient oxygen for oxidizing the post-retorting gas, into a selected location in the fragmented mass on the trailing side of the combustion zone; and controlling the composition of the retort inlet mixture so that the spontaneous ignition temperature of the retort inlet mixture is less than the temperature in the primary combustion zone and less than the temperature of said selected location, such that a secondary combustion zone is formed at said selected location.

77. The method of claim 76 wherein at least a portion of the boundaries of unfragmented formation adjacent the secondary combustion zone is maintained at a temperature higher than about 900° F.

* * * * *